United States Patent [19]

Brown

[11] 4,086,379

[45] Apr. 25, 1978

[54] MULTI-LAYERED LAMINATES

[75] Inventor: Lyman J. Brown, La Grange, Ill.

[73] Assignee: Bates Printing Specialties, Inc., Cicero, Ill.

[21] Appl. No.: 711,727

[22] Filed: Aug. 5, 1976

[51] Int. Cl.[2] ..... B44C 1/16

[52] U.S. Cl. ..... 428/40; 428/79; 428/187; 428/914

[58] Field of Search ..... 428/40, 41, 42, 187, 428/914, 79; 40/2 R; 283/18–21

[56] References Cited

U.S. PATENT DOCUMENTS

| | | | |
|---|---|---|---|
| 2,219,071 | 10/1940 | Humphner | 428/914 X |
| 3,411,978 | 11/1968 | Frohbach et al. | 428/42 |
| 3,556,894 | 1/1971 | Bernard | 428/40 X |
| 3,616,176 | 10/1971 | Jachimowicz | 428/914 X |
| 3,896,249 | 7/1975 | Keeling et al. | 428/914 X |
| 3,925,585 | 12/1975 | Aoyagi | 428/42 |

*Primary Examiner*—George F. Lesmes
*Assistant Examiner*—Henry F. Epstein
*Attorney, Agent, or Firm*—Kinzer, Plyer, Dorn & McEachran

[57] ABSTRACT

A multi-layered item such as a trading card, a poster or a peel-off sticker having a transferable hot melt adhesive design. The trading card includes a piece of card stock having a design or illustration on at least one side thereof. A release coating of silicone or a silicone base substance is applied to the design or illustration side of said card stock. A hot melt adhesive film is adhered to the release coated side of the card stock. A design or illustration is located on the outward facing side of the hot melt adhesive film. The outwardly facing design or illustration is the same as the design or illustration on the base card stock.

2 Claims, 6 Drawing Figures fig.4.
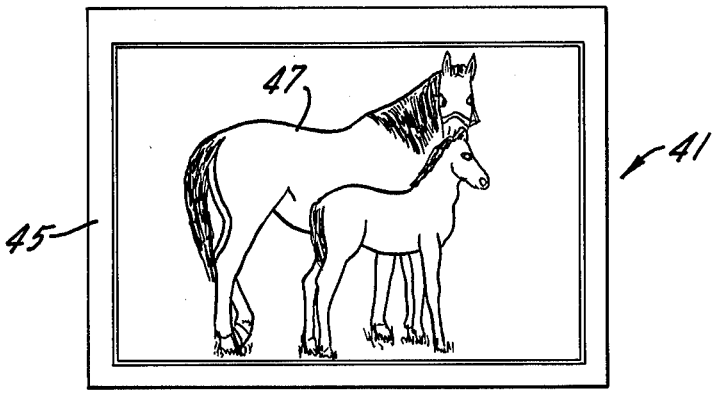
fig.5.
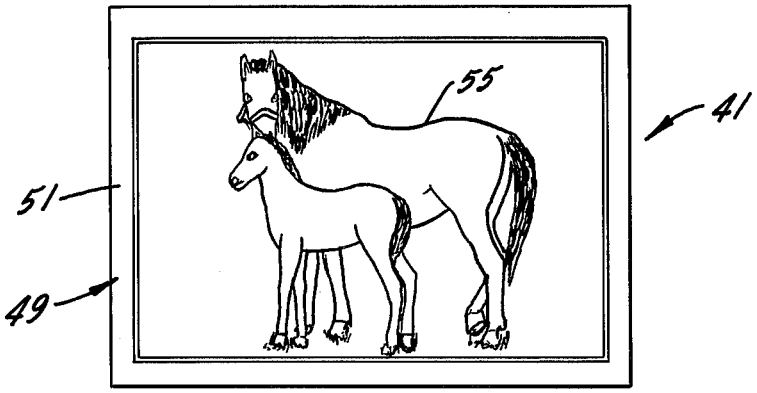
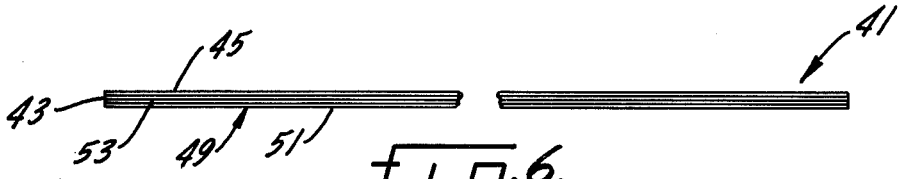
fig.6.

MULTI-LAYERED LAMINATES

SUMMARY OF THE INVENTION

This invention is concerned with premium or novelty items such as trading cards, and peel-off stickers, posters and, more specifically, with such items having an iron-on film which is removable from the trading card, or peel-off stickers and carries an illustration or design identical to that found on the trading card, poster or peel-off sticker.

An object of this invention is a trading card, poster or peel-off sticker having a removable iron-on film laminated thereto.

Another object is a trading card, or poster or peel-off sticker having an iron-on film which can be transferred to an article of clothing without damaging the trading card, or peel-off sticker.

Another object is a trading card, or poster or peel-off sticker having an attached iron-on portion which can be inserted in a food package without requiring a separate overwrap.

Other objects may be found in the following specification, claims and drawings.

BRIEF DESCRIPTION OF THE DRAWINGS

The invention is illustrated more or less diagrammatically in the following drawings wherein:

FIG. 4 is a front plan view of a peel-off sticker having a hot melt adhesive film;

FIG. 5 is a rear plan view of the peel-off sticker of FIG. 4; and

FIG. 6 is an edge view of the peel-off sticker of FIG. 4.

DESCRIPTION OF THE PREFERRED EMBODIMENTS

Figure 1:
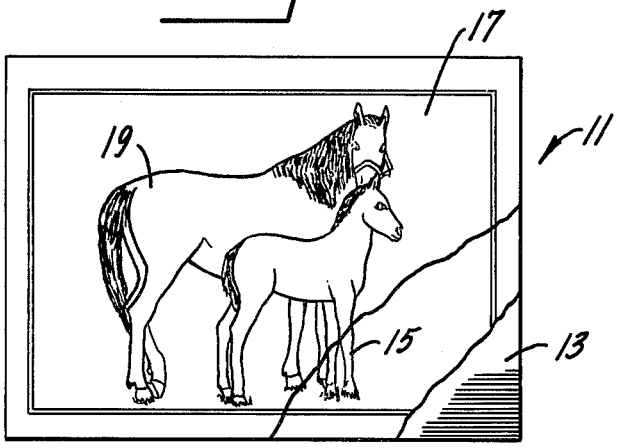
FIG. 1 is a top plan view of a combination trading card having a hot melt adhesive transfer film made in accordance with the teachings of this invention with parts broken away for clarity of illustration.

A combination trading card and hot melt adhesive transfer 11 embodying the novel features of this invention is shown in FIG. 1 of the drawings. The trading card is formed of a rectangular piece 13 of card stock. An illustration or design 15 is graphically applied, as by printing, to one face of the card stock 13. The illustration or design 15 may be printed in multi-colors, for example, using a conventional four color printing press. It should be understood that the illustration or design may be applied by any of the other conventional methods known to those in the graphic arts. The outer surface of the card stock having the illustration or design 15 is coated with a release agent, not shown for clarity of illustration, which is preferably a silicone base or silicone containing material. Located against the surface of the card stock to which the release agent is applied is a heat seal adhesive film 17 of approximately 0.003 inches thickness. The heat seal adhesive film may be selected from materials which are solid and non-sticky at normal ambient temperatures but become adhesive upon the application of heat. Suitable films are well known in the art and may include compositions comprised of ethylene vinyl acetate copolymers and polyvinyl butyral. Other suitable films include thermoplastic polyurethanes which are high molecular weight polymers not containing free isocyanate groups. Also, Nylon 11 and 12 may be used for applications requiring higher heat resistance. Another suitable type of hot melt film may be made from a neutral polyamide.

An illustration or design 19 is formed on the exposed or outer face of the heat seal adhesive film 17. The illustration or design may be applied by ink, paint or other suitable material which is sufficiently stable to maintain its configuration under transfer temperatures in the range of 350° F. While the design or illustration shown in this embodiment consists of a representation of animals, it should be understood that any other design or illustration may be used such as insignia, indicia including words, letters, etc. Since the design or illustration will be transferred along with the heat seal adhesive film 17, the design or illustration as shown on the film adhered to the trading card, will normally be a mirror image of the image desired to be applied to the transfer receiving surface. The illustrations 15 and 19 are usually identical.

Instructions for effectuating the transfer of the hot melt adhesive film 17 from the card stock 13 to an article of clothing or other transfer receiving substance may be printed on the opposite surface of the card stock 13. Since the application of printed instructions to one side of a trading card is conventional, it is not shown in the drawings.

Figure 2:
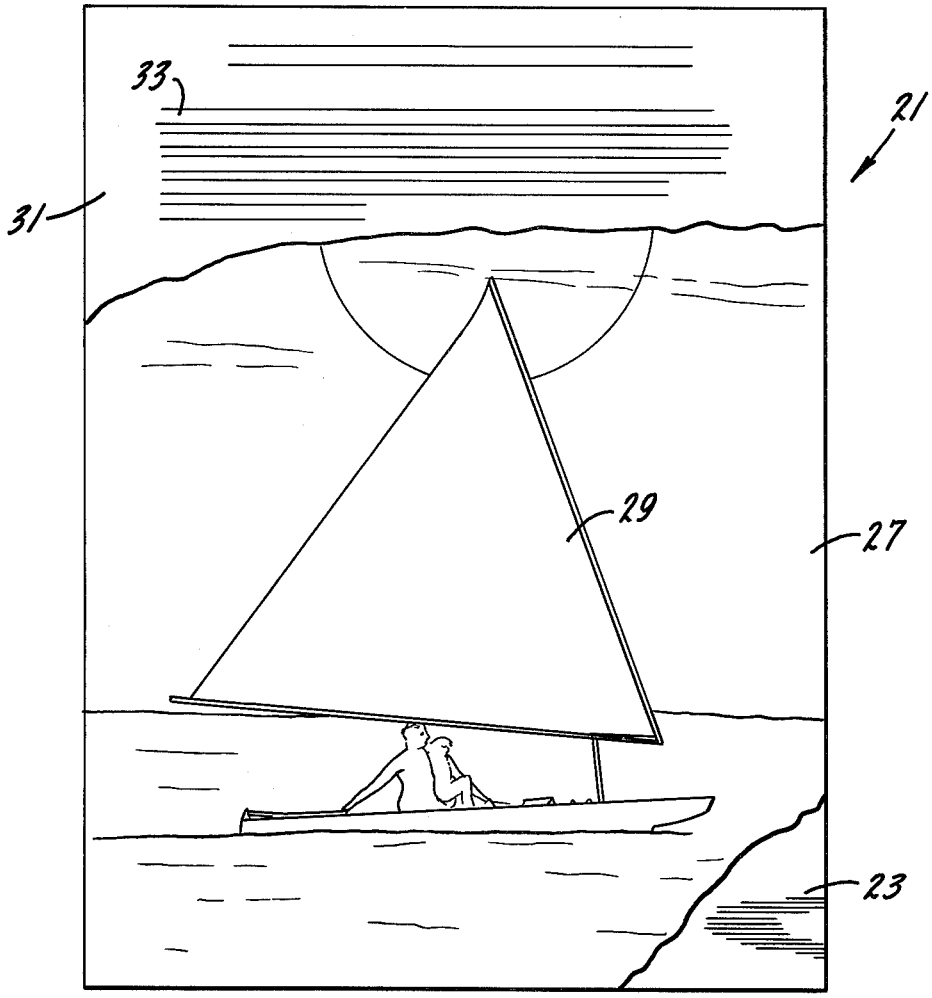
FIG. 2 is a top plan view of a poster having a hot melt adhesive transfer film made in accordance with the teachings of this invention with portions thereof broken away for clarity of illustration.
Figure 3:
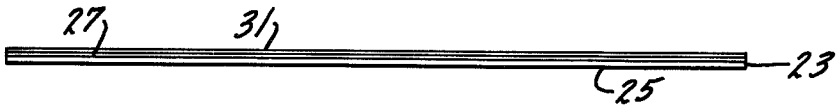
FIG. 3 is an edge view of the assembly of FIG. 2 slightly enlarged for clarity of illustration.

FIGS. 2 and 3 of the drawings shows a combination poster and heat seal adhesive transfer 21. The poster is formed of a rectangular piece 23 of heavy grade poster paper. An illustration or design 25 is graphically applied, as by printing, to one face of the poster paper. The illustration may be printed in multi-colors, for example, using a conventional four color printing process. Of course, the illustration may be applied to the poster paper by any conventional method known to those in the graphic arts. The surface of the paper opposite to that having the illustration 25 is coated with a release agent, not shown for clarity of illustration, which is preferably a silicone base or silicone containing material. Positioned against the surface of the poster paper to which the release agent is applied is a heat seal adhesive film 27 of approximately 0.003 inches thickness. The heat seal adhesive film may be the same as that previously described for use with the trading card 11.

An illustration or design 29 is applied to the exposed surface of the heat seal adhesive film 27. This illustration or design may be applied by ink, paint or other suitable material which is sufficiently stable to maintain its configuration under transfer temperatures in the range of 350° F. For the reasons previously mentioned, the illustration or design 29 would be identical to the illustration or design 25. A protective sheet of paper 31 is applied over the surface of the heat seal adhesive film 27 having the illustration or design 29. Instructions 33 for adhering the heat seal adhesive film to an article of clothing or other transfer receiving substance are printed on the outer surface of the protective sheet 31. In use, the protective sheet 31 is removed and the heat seal adhesive film would be positioned against the garment or other transfer receiving substance to which the heat seal adhesive film and its illustration 29 are to be transferred. Heat is applied to the front surface of the poster 21. After applying sufficient heat, the poster 23 is lifted off and the heat seal adhesive film has been applied with its illustration 29 to the garment. The poster 23 and its illustration 25 are intact and useable.

FIGS. 4, 5, and 6 of the drawings show a combination self-sticking label or peel-off sticker and heat seal adhesive transfer 41. The self-sticking label combination 41 includes a first sheet 43 of paper or card stock. The opposite faces of this sheet are coated with a release agent, which is not shown for clarity of illustration, but is preferably a silicone base or silicone containing substance. Located against one surface of the first sheet 43 is a heat seal adhesive film 45 of approximately 0.003 inches thickness. The heat seal adhesive film may be the same as that previously described for use with the trading card 11.

An illustration or design 47 is applied to the outer surface of the heat seal adhesive film 45. This illustration or design may be applied by ink, paint or other suitable material which is sufficiently stable to maintain its configuration under transfer temperatures in the range of 350° F. The indicia or design is printed on the outwardly facing surface of the heat seal adhesive film 45 and is a mirror image of the design which is desired to be shown when the heat seal adhesive film is removed from a combination and applied to an article of clothing or the like.

A peel-off sticker or detachable label 49 is located against the opposite surface of the first sheet 43 and includes a sheet of paper or card stock 51 having a layer 53 of a pressure sensitive adhesive on one side thereof and an illustration or design 55 on the opposite side thereof. The illustration or design 55 may be identical to or different than the illustration or design 47 applied to the heat seal firm 45. The pressure sensitive adhesive 53 is positioned directly against the release coating on the first sheet.

The peel-off sticker and hot melt adhesive transfer combination 41 provides a device that can be used both as a means of transferring a design to an article of clothing or the like and as a self adhering label or peel-off sticker which carries its own decorative design. The combination 41 provides a novelty item having a peel-off sticker which can first be removed and applied to an object and a hot melt adhesive transfer design which could then be adhered to an article of clothing by the application of heat to the first sheet 43. Combination articles of this type may be used as premiums in food packages and for other similar purposes.

I claim:

1. A multi-layered item including:

a first sheet of paper, a hot melt adhesive film releasably adhered to said first sheet of paper on a side thereof, indicia located on an outwardly facing side of said hot melt adhesive, a second sheet of paper releasably secured to the opposite side of said first sheet of paper by a pressure sensitive adhesive, said pressure sensitive adhesive being applied so as to remain with said second sheet of paper when said sheets of paper are separated in order that said second sheet of paper may be adhered to other objects, and indicia applied to the outwardly facing side of said second sheet of paper with said indicia applied to said second sheet of paper being substantially identical to said indicia located on the outwardly facing side of said hot melt adhesive.

2. The multi-layered item of claim 1 in which release coatings are positioned between said first sheet of paper and said hot melt adhesive film and between said first sheet of paper and said pressure sensitive adhesive.

* * * * *